United States Patent [19]

Gillette et al.

[11] Patent Number: 5,054,208

[45] Date of Patent: Oct. 8, 1991

[54] TUBULAR DIFFUSER

[75] Inventors: William J. Gillette, Severna Park; Joseph L. Hemler, Jr., Stevensville, both of Md.

[73] Assignee: Novatec, Inc., Baltimore, Md.

[21] Appl. No.: 651,722

[22] Filed: Feb. 7, 1991

[51] Int. Cl.[5] ..... F26B 13/10

[52] U.S. Cl. ..... 34/57 A; 239/553.3

[58] Field of Search ..... 34/27, 50, 80, 79, 81, 34/218, 219, 225, 57 A, 57 R, 57 B; 239/553.3, 567

[56] References Cited

U.S. PATENT DOCUMENTS 3,621,585 11/1971 Robertson .
3,888,423 6/1975 Ganiaris .
4,257,171 3/1981 Johnson et al. .
4,509,272 4/1985 Graff ..... 34/32 X
4,656,757 4/1987 Oschmann ..... 34/80 X
4,879,958 11/1989 Allen et al. .
4,974,337 12/1990 Tavakoli et al. ..... 34/80 X

*Primary Examiner*—Henry A. Bennet
*Attorney, Agent, or Firm*—Banner, Birch, McKie & Beckett

[57] ABSTRACT

The present invention discloses a diffuser for use in a drying system and more particularly, a tubular diffuser for use in a drying hopper. The present invention is especially useful in the conditioning of resin pellets prior to molding or extruding. It is comprised of a hollow perforated body, a closed end, an open end through which clean, warm, dry air may be supplied, and a stiffener.

17 Claims, 1 Drawing Sheet

TUBULAR DIFFUSER

FIELD OF THE INVENTION

The present invention is related to a diffuser for use in a drying system and more particularly, to a tubular diffuser for use in a drying hopper for drying resins.

BACKGROUND OF THE INVENTION

In the conditioning of plastic resins for a molding or extruding process, the plastic resins are frequently pelletized and introduced into production via a drying hopper, wherein the plastic pellets are dried for a period of time prior to processing. Generally, plastic resins which are affected by moisture fall into two classifications, namely hygroscopic and non-hygroscopic. Non-hygroscopic resins collect moisture on the surface of the pellet only. This surface moisture can be removed by a relatively simple process involving the application of warm air to the material. Since warmer air has the ability to hold water, when it is passed in a stream over the resin, the moisture tends to leave the surface of the pellet in favor of the warm air stream, and dry resin results. A different situation is present, however, in the case of hygroscopic resins. These resins attract moisture from the ambient air and collect moisture inside the pellet itself. If this moisture is not removed from the pellets prior to processing, harmful splays or defects in the physical properties of the finished product will result. Hence, drying systems must be utilized to deliver dry air as well as heat to the resin pellets, prior to processing, to thereby remove the moisture from the pellets. The drying system for which the present invention is specifically designed is a closed loop system, although use in other type of drying systems is possible. A closed loop drying system generally consists of a desiccant dehumidifier and a drying tank or hopper, wherein the moisture laden air exiting from the hopper is cleaned in a filter, dried in the desiccant dehumidifier, and heated to the desired temperature before being recirculated back to the drying hopper.

Within the drying hopper is a device used to diffuse the clean, dry, warm air such that all of the pellets are contacted during a predetermined period of time. This diffusing device must be constructed in such a way as to allow proper distribution of the air, and at the same time, it should promote the "plug flow" of the material as it passes through the drying hopper. Plug flow is achieved when all of the pellets at any one level move uniformly through the hopper. If the diffuser is not so constructed, funneling or channeling of the material as it flows around the diffuser will occur. As a result of funneling, some of the plastic pellets in the drying hopper will not receive proper exposure to the dry air and others will receive too much, thus reducing the strength and/or appearance of the plastic resin.

Prior art diffusers have typically had either a double conical or a diamond formation. The double conical diffuser is positioned in the hopper base and extends entirely across the diameter thereof. It is comprised of two conical portions, one being smaller than the other and positioned inversely above the larger cone. In this prior art embodiment, the warm, dry air moves in a circular motion within the diffuser and is directed upwards therefrom into the hopper. Due to the air being moved upwards, the materials located in the bottom of the hopper may not be evenly heated and dried upon start-up of the drying system. In turn, this can result in harmful splays and defective products as discussed above. In addition, hot spots may develop at the inlet to the diffuser unless the air is made to enter the diffuser tangentially. The diamond diffuser is also positioned in the hopper base, but it does not extend across the entire diameter. As a result in this instance, some of the material will flow around the diffuser as it travels to the hopper outlet. This creates funneling of the pelletized resin, decreases the uniformity of the heating and drying of the pellets, and hinders the plug flow of the material.

Another disadvantage of both the double conical and diamond diffusers is the difficulty encountered when removal from the hopper base is required, such as for cleaning. Some hoppers in the prior art are provided with a hinged door through which access to the resin pellets may be gained when necessary and through which the diffuser may be removed; however, the door is not always large enough for this to be easily accomplished. Thus, removal of the diffuser becomes an arduous task typically requiring several attempts and various contortions before the diffuser is successfully manipulated through the hopper door.

A strong need therefore exists for a diffuser which evenly distributes the warm, dry air throughout all the contents of the hopper, promotes the plug flow of the resin pellets, and may also be easily removed from the hopper base.

SUMMARY OF THE INVENTION

Accordingly, it is a primary object of the present invention to provide a diffuser which meets the above criteria by dispersing the air evenly throughout the material in the hopper and by promoting complete plug flow.

It is also an object of the present invention to provide a diffuser which can be easily removed from the hopper for cleaning as different colors of resin or types of resin are loaded into the drying hopper.

The above and other objects are achieved by mounting a diffuser of the present invention transversely in the conical base portion of a drying hopper. The diffuser is comprised of a hollow cylindrical body having an open end through which air is received and a closed end defined by an end plate. Additionally, an inverse V-shaped stiffener is attached along the top of the diffuser.

These and other objects, advantages and features of the present invention will be more fully understood and appreciated by reference to the written specification and appended drawings.

DETAILED DESCRIPTION OF THE INVENTION

Figure 1:
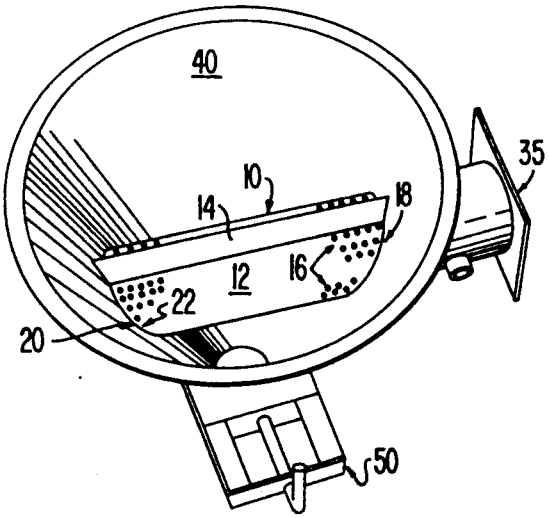
FIG. 1 is a perspective view of the diffuser of the present invention mounted in the conical base of a hopper.
Figure 2:
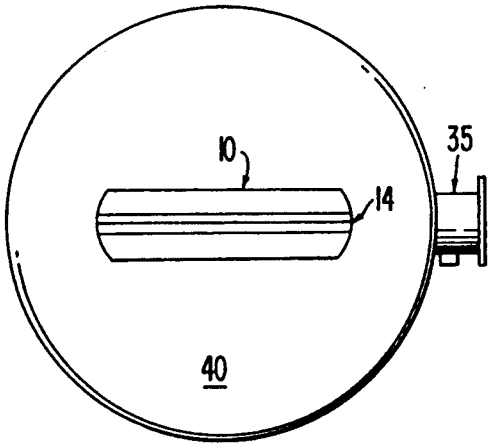
FIG. 2 is a top plan view of the hopper base with the diffuser of FIG. 1.

A tubular diffuser 10 mounted for use in a conical base of a drying hopper 40 is shown generally in FIGS. 1 and 2. The drying hopper generally consists of an upper storage tank part (not shown) and a conical base part 40 for dispensing the pellets therefrom. The tubular diffuser 10 is comprised of a hollow cylindrical body 12 and an angled stiffener 14 attached longitudinally across the upper surface of the cylindrical body 12. The cylindrical body 12 of the tubular diffuser is comprised of a perforated sheet 16 forming the body, an open end 18 through which air enters the hopper from inlet port 35 and a closed end 20 defined by an end plate 22 positioned within the hopper. The end plate 22 is preferably a solid disk.

Figure 3:
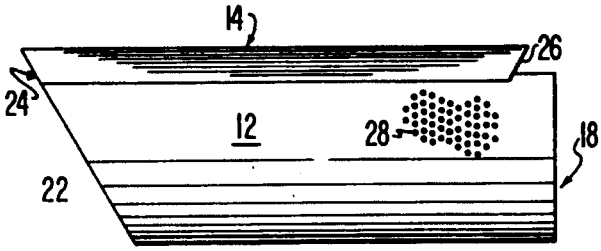
FIG. 3 is a side elevational view of the diffuser of the present invention.
Figure 4:
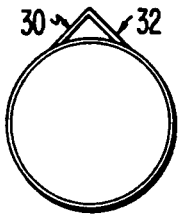
FIG. 4 is an end elevational view of the diffuser as seen from the left in FIG. 3.

Referring to FIGS. 3 and 4, the stiffener 14, in its preferred form, is comprised of a solid strip of sheeting bent along its longitudinal axis to obtain an inverse V-shaped configuration formed by two sidewalls 30, 32 with a 90 degree angle therebetween. The two sidewalls 30, 32 are fastened lengthwise to the upper surface of the diffuser body 12 so as to have one end 24 aligned with end plate 22 and the other end 26 aligned with the conical base of the hopper 40, after open end 18 is positioned within inlet port 35 as described below. Alignment in this instance is the abutment and paralleling of the diffuser surfaces with the sidewalls of the conical base of hopper 40. As illustrated by FIGS. 1 and 3, the conical base of the hopper 40 preferably has sidewalls formed at a 60 degree angle, although other configurations may of course be used for particular applications. The closed end 20 defined by end plate 22 is also formed at approximately a 60 degree angle so that it generally parallels the conical side wall of the hopper 40. Similarly, both ends 24, 26 of the stiffener 14 are also cut at an approximately 60 degree angle.

The diffuser of the present invention is releasably attached within the drying hopper so that it may be easily removed through a hinged door (not shown) located on the exterior of the dryer housing (not shown). The open end 18 of the diffuser body 12 is designed to slide into the inlet port 35 from which the clean, dry, warm air is delivered. By making the open diffuser end 18 slightly smaller than the inlet port 35 a slip fit is obtained. This enables the diffuser 10 to be easily installed and removed from the hopper for cleaning or maintenance, without compromising the structural integrity of the drying hopper or requiring disassembly of the closed loop drying system. The ease of the slip fit of the tubular diffuser combined with its cylindrical shape provides a significant improvement over the prior art, enabling removal through the hinged door to be made without the contortions previously required.

The tubular diffuser of the present invention may be utilized for any sized pellet and in any sized hopper. For example, in one instance for a smaller hopper the tubular diffuser may be designed to be approximately twelve inches in length with a five inch diameter, the stiffener thereon having one inch wide sidewalls and a length approximately one-half inch less than the top length of the diffuser body. However, if the drying system requires the hopper to be larger, the tubular diffuser may also be designed accordingly. In all cases, however, it is important that the diffuser extend across the entire diameter of the hopper in order to avoid funneling of the plastic resin.

During operation of the closed loop drying system, the warm air from inlet port 35 enters the drying hopper 40 via the open diffuser end 18 and is distributed throughout the contents of the drying hopper by way of the perforations 28 in the diffuser tube 10. After being sufficiently warmed and dried, the contents of the hopper will be discharged by way of the slide gate 50, as shown in FIG. 1. By providing perforations 28 on the entire periphery of the diffuser tube 10 an improved distribution of the warm air over that of the prior art is achieved. Specifically, by directing the flow of the air from the entire periphery, including downwards, the tubular diffuser of the present invention improves the distribution of the warm air to the material in the bottom of the drying hopper, around the sides of the drying hopper, and in the critical drying region as well. This critical drying region is defined as the location inside the hopper where maximum pellet drying occurs. In this location, the pellets are exposed to the lowest dew points and highest possible process air temperatures, the combination of which causes the moisture to migrate at the maximum rate and also achieve the lowest possible equilibrium moisture content. Since the present invention tubular diffuser extends across the entire diameter of the hopper base, the possibility of funneling has been diminished from that of the prior art. By providing a stiffener with sloping sides on the upper surface of the tubular diffuser, the circulation of resin pellets over and around the diffuser is greatly enhanced. The stiffener is designed such that the sloping sides will enhance the flow of the material around the diffuser, yet care is also taken to ensure that the stiffener does not block too great of number of the perforations, thereby restricting the necessary air flow. The optimum stiffener size must be large enough to create sloping surfaces for the pellets to flow freely but not so large that it inhibits the air directed upwards from the diffuser body. In addition, by angling the ends of the stiffner and the closed end of the tubular diffuser to parallel the conical base of the hopper, any obstructing surfaces that would potentially inhibit the flow of the resin pellets have been eliminated, thus plug flow is also improved over that of the prior art.

This invention has been described in detail in connection with the preferred embodiment. This embodiment, however, is merely for example only and the invention is not restricted thereto. It will be understood by those skilled in the art that other variations and modifications can be easily made within the scope of this invention as defined by the appended claims.

We claim:

1. In a drying system used for the conditioning of plastic resins prior to use in molding or extruding processes, having a dehumidifier, a drying hopper including a conical base, air supplying means for supplying clean, dry, warm air from said dehumidifier to said drying hopper through an inlet port, and diffusing means for diffusing clean, dry, warm air throughout the resin pellets located in the drying hopper, the improvement wherein said diffusing means comprises:

a tubular diffuser mounted transversely in said drying hopper base;

said tubular diffuser further comprising a hollow cylindrical body having an open end and a closed end, said open end of said diffuser connected to said air supply means and said closed end of said diffuser terminating adjacent a conical sidewall of said drying hopper so that the resin pellets cannot flow between said diffuser and said sidewall, whereby said resin pellets are heated and dried uniformly.

2. A drying system as recited in claim 1, wherein said closed end of said hollow cylindrical body is defined by a solid disk end plate.

3. A drying system as recited in claim 1, wherein said hollow cylindrical body of said tubular diffuser is comprised of a plurality of perforations dispersed over the entire periphery so that air exits the diffuser through said perforations.

4. A drying system as recited in claim 1, further comprising a stiffener for said diffuser and wherein said stiffener comprises a strip slightly less than the length of said tubular diffuser, said strip having two ends and said strip being folded along its longitudinal axis to thereby form two sides with an angle therebetween.

5. A drying system as recited in claim 4, wherein the two sides of said stiffener are attached longitudinally to the upper surface of said hollow cylindrical body.

6. A drying system as recited in claim 4, wherein the ends of said stiffener are cut at an appropriate angle to thereby parallel said conical drying hopper base.

7. A drying hopper incorporating a tubular diffuser comprising:

a conical drying hopper base;

a tubular diffuser body extending across said base;

a stiffener; and an air inlet port through which clean, dry, warm air is supplied to said tubular diffuser.

8. A drying hopper as recited in claim 7, wherein said tubular diffuser comprises a hollow cylindrical body, an open end and a closed end, said open end of said diffuser connected to said air inlet port and said closed end of said diffuser terminating adjacent said conical drying hopper base so that the resin pellets cannot flow between said diffuser and said conical drying hopper base, whereby said resin pellets are heated and dried evenly.

9. A drying hopper as recited in claim 8, wherein said hollow cylindrical body is constructed from a sheet having uniform perforations throughout.

10. A drying hopper as recited in claim 8, wherein said closed end of said hollow cylindrical body is defined by a solid disk end plate.

11. A drying hopper as recited in claim 8, wherein said open end of said tubular diffuser is removably attachable to said inlet port.

12. A drying hopper as recited in claim 7, wherein said stiffener comprises a strip slightly less than the length of said tubular diffuser, said strip having two ends, and said strip being folded along its longitudinal axis to thereby form two sides.

13. A drying hopper as recited in claim 12, wherein the two sides of said stiffener are attached longitudinally to the upper surface of said tubular diffuser.

14. A drying hopper as recited in claim 13, wherein the ends of said stiffener are cut at approximately a 60 degree angle thereby paralleling conical drying hopper base.

15. A drying hopper as recited in claim 12, wherein the angle between said two sides of said stiffener is 90 degrees.

16. A drying system as recited in claim 4, wherein the angle between said two sides of said stiffener is 90 degrees.

17. A drying system as recited in claim 6, wherein said ends of said stiffener are cut at an approximately 60 degree angle.

* * * * *